US005310366A

United States Patent [19]

Milner

[11] Patent Number: 5,310,366

[45] Date of Patent: May 10, 1994

[54] EASILY DISASSEMBLED ELECTRICAL CONNECTOR FOR HIGH VOLTAGE, HIGH FREQUENCY CONNECTIONS

[75] Inventor: Joseph R. Milner, Livermore, Calif.

[73] Assignee: The United States of America as represented by the United States Department of Energy, Washington, D.C.

[21] Appl. No.: 76,059

[22] Filed: Jun. 14, 1993

[51] Int. Cl.[5] ..... H01R 4/38

[52] U.S. Cl. ..... 439/807; 269/234

[58] Field of Search ..... 439/807, 790–794; 269/234, 217

[56] References Cited

U.S. PATENT DOCUMENTS 4,032,212 6/1977 Faust et al. ..... 439/791

*Primary Examiner*—Gary F. Paumen

*Attorney, Agent, or Firm*—Miguel A. Valdes; Roger S. Gaither; William R. Moser

[57] ABSTRACT

An easily accessible electrical connector capable of rapid assembly and disassembly wherein a wide metal conductor sheet may be evenly contacted over the entire width of the conductor sheet by opposing surfaces on the connector which provide an even clamping pressure against opposite surfaces of the metal conductor sheet using a single threaded actuating screw.

13 Claims, 6 Drawing Sheets

EASILY DISASSEMBLED ELECTRICAL CONNECTOR FOR HIGH VOLTAGE, HIGH FREQUENCY CONNECTIONS

The invention described herein arose in the course of, or under, Contract No. W-7405-ENG-48 between the U.S. Department of Energy and the University of California for the operation of the Lawrence Livermore National Laboratory.

BACKGROUND OF THE INVENTION

This invention relates to an easily disassembled electrical connector for effectively coupling a high voltage, high frequency pulsed power supply with another electrical component. More particularly, this invention relates to a removable electrical connector for use in electrically coupling a pulsed laser power supply to a laser head.

In the past, electrical connectors, such as the connectors shown in prior art FIGS. 1 and 2, were used to couple a pulsed laser power supply 2 with a laser head 4. Such connectors comprised a plurality of bolts 10 and washers 12 which secured the respective ends of a number of conductive sheets 14 to contact 8 at laser head 4 and contact 6 at pulsed power supply 2. However, the electrical components used in the power supply can experience failure, resulting in the need to unfasten the power supply from the laser head. Such multiple connections interfere with rapid disconnection of the power supply and replacement of components therein. Furthermore, the proximal location of the power supply and the laser head to one another, for electrical reasons, results in added difficulty in removing and replacing multiple bolts, due to the resulting space constraints.

The use of such a plurality of narrow connector strips 14, as shown in the prior art connections, also increases the possibility of arcing across the conduction paths, a condition exacerbated by the high frequencies present in the quickly rising high voltage pulses. Arcing is undesirable for several reasons. One reason is that arcing causes localized high-power and heat dissipation inducing rapid component failure. Furthermore, arcing creates electrical noise strong enough to affect operation of nearby electrical devices. In addition, arcing can produce large amounts of ozone which is a corrosive agent for certain materials and, in any event, is an undesirable byproduct of such arcing, from both health and environmental considerations.

It would, therefore, be desirable to provide a replacement electrical connector for use with a laser head and the laser power supply which would be more easily accessible, and more easily disassembled in a shorter period of time, while at the same time reducing arcing at the connectors and the resultant effects of such arcing.

SUMMARY OF THE INVENTION

It is, therefore, an object of this invention to provide an easily accessible electrical connector capable of rapid assembly and disassembly wherein a wide metal conductor sheet may be evenly contacted over the entire width of the conductor sheet by opposing surfaces on the connector which provide an even clamping pressure against opposite surfaces of the metal conductor sheet using a single threaded actuating screw.

The connector comprises a two piece connector held together with a single actuating screw. A first segment of the two piece connector is formed with a series of parallel teeth which are slanted with respect to a contacting surface on the first connector segment which will contact one surface of the metal conductor sheet. A second segment of the connector has a matching contact surface disposed parallel to the first contacting surface when the two connector segments are fitted and secured together by the actuating screw. The slanted teeth on the first connector segment fit into a recess in the second connector segment where the teeth engage a series of spaced apart rods in the second connector segment which bridge the recess. As the actuating screw is tightened, camming surfaces on the angled teeth engage the rods and urge the first connector segment in a direction perpendicular to the actuating screw axis toward the second connector segment so that both contacting surfaces will exert even pressure, along the entire length of the contacting surfaces, against the opposite surfaces of a conductor sheet placed betwen the contacting surfaces of the connector.

BRIEF DESCRIPTION OF THE DRAWINGS

FIG. 6 is an isometric view of the connector of FIG. 3, but with the two connector segments already engaged and being tightened together so that the gap between the respective conductor sheet contacting surfaces of the two connector segments is just barely large enough to still permit insertion of the conductive sheet there between.

DETAILED DESCRIPTION OF THE INVENTION

Figure 1:
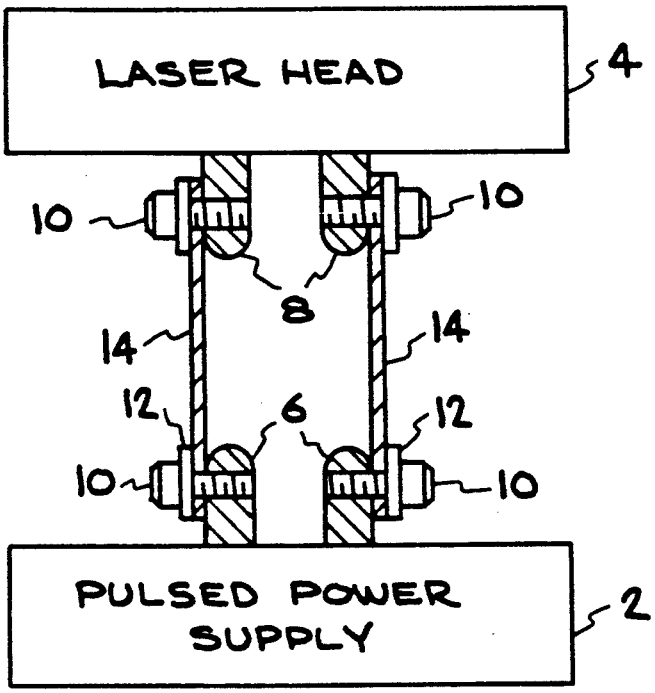
FIG. 1 (PRIOR ART)
FIG. 1 is a top view of a prior art connector assembly showing the topmost bolts and conducting strip used to electrically connect a laser head to its pulsed power supply.
Figure 2:
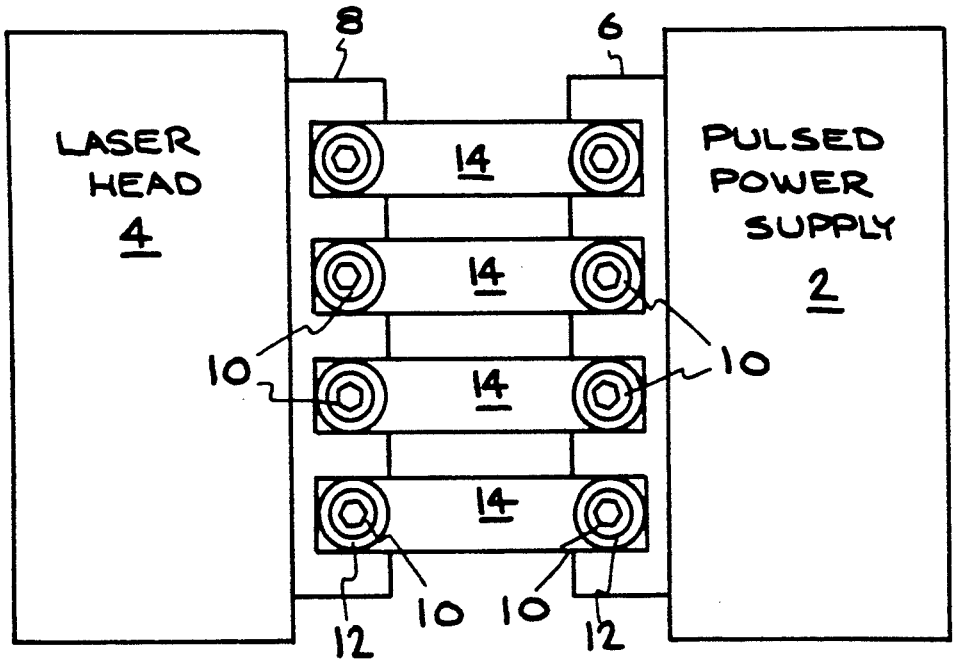
FIG. 2 (PRIOR ART)
FIG. 2 is a side view of the same prior art connector assembly shown in FIG. 1, but illustrating the plurality of conductor strips and bolts which comprise the connector assembly.
Figure 3:
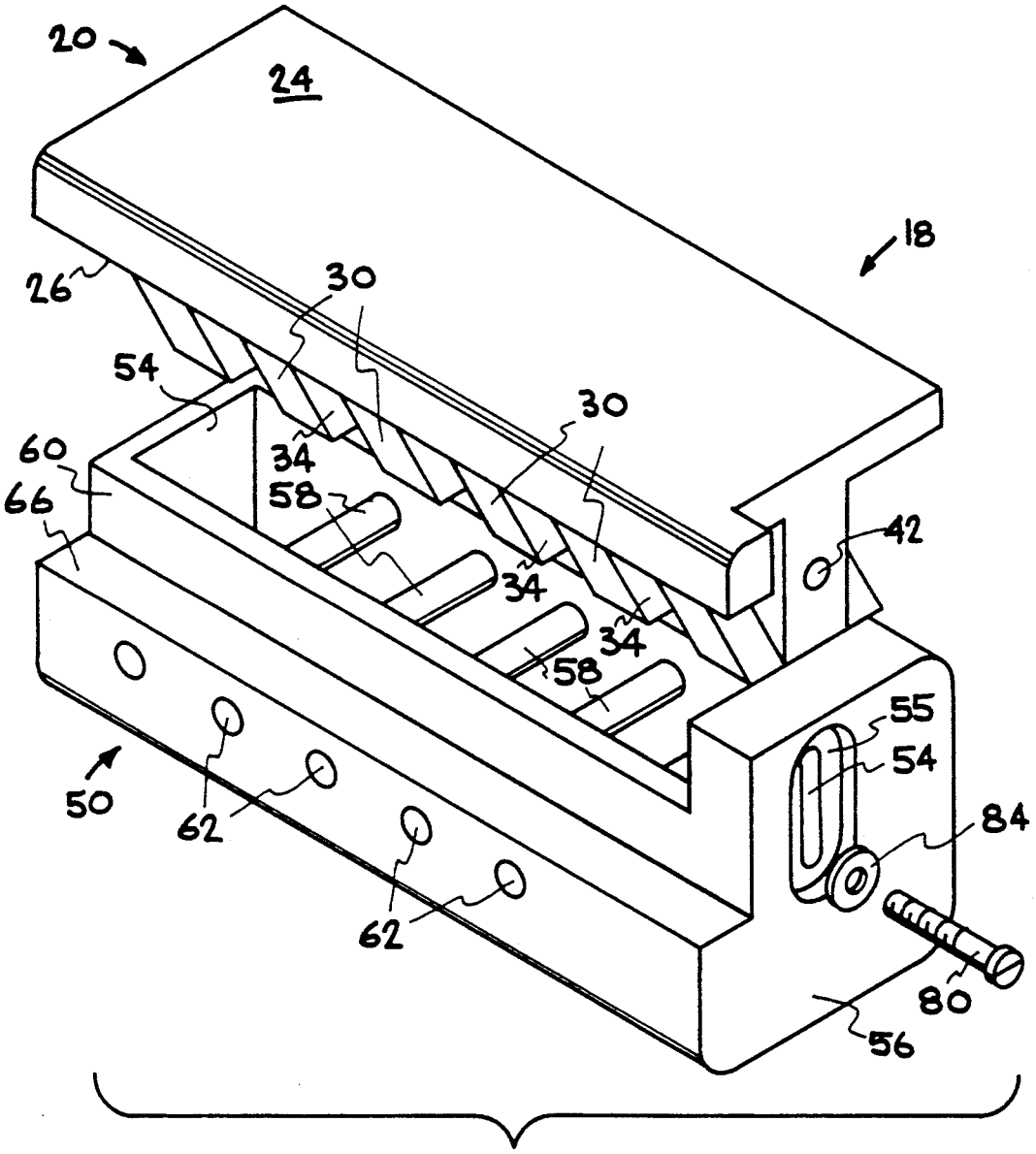
FIG. 3 is an isometric partially exploded view of the two piece connector of the invention showing the slanted teeth on the first connector segment being inserted into the recess in the second connector segment to engage the rods spanning the recess in the second connector segment.

In FIG. 3, the connector of the invention is generally illustrated at 18 comprising a first connector segment 20 and a second connector segment 50. First connector segment 20 comprises a generally rectangular block 24 from which depends a plurality of teeth 30 which are slanted at an angle, to the planar surface of block 24, which may range from as little as about 10° to as much as about 80°, preferably from about 25° to about 65°, more preferably from about 30° to about 60°, and most preferably from about 40° to about 50°, with the angle typically about 45°. Each tooth 30 has a camming surface 34 provided thereon which is used to engage a rod 58 on second connector segment 50 as will be described below.

Figure 4:
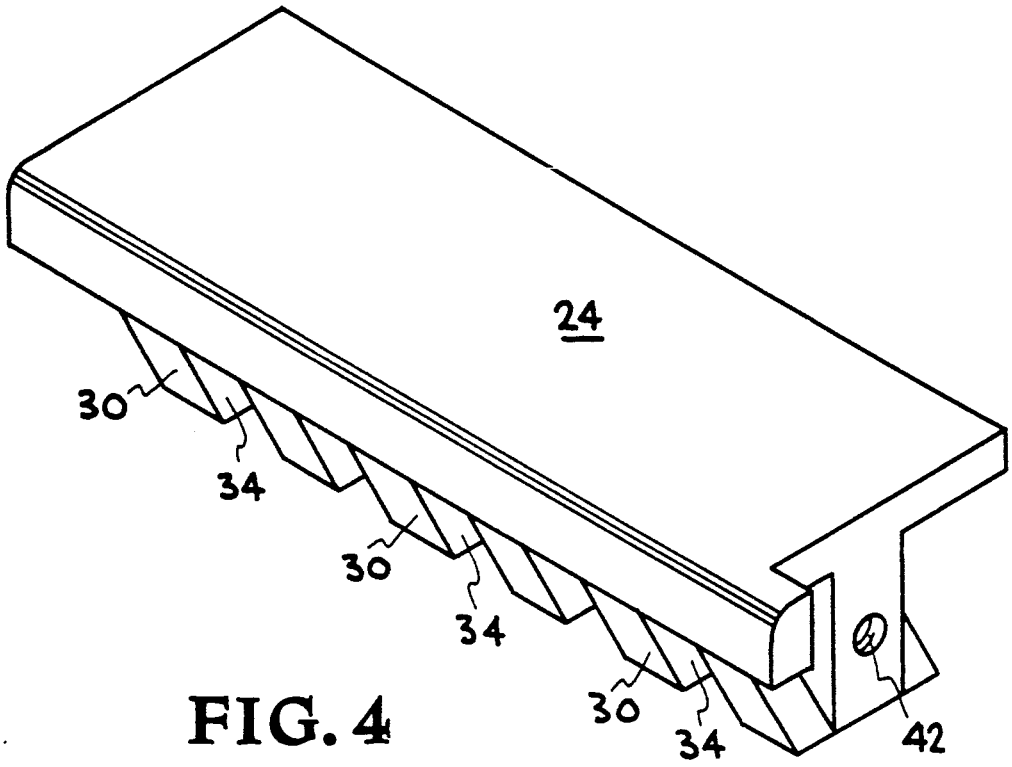
FIG. 4 is fragmentary isometric view of a segment of the upper connector segment partially broken away to reveal the threaded bore at one end of the upper connector segment.

Block 24 is further provided, on one portion of its underside, with a conductor contact surface 26 extending along one edge of the undersurface of block 24. Conductor contact surface 26 will engage one surface of conductor sheet 100, (shown in FIGS. 6 and 7), which may be used, for example, to interconnect power supply 2 with laser head 4. A threaded bore 42 is also provided on one end 40 of block 24, as shown in FIG. 4. An actuating screw 80, passing through a slotted or oval opening 54 in second connector segment 50, is received in a threaded bore 42 in first connector segment 20 (see FIG. 4) to draw the two segments together, in cooperation with camming surfaces 34 on teeth 30 and rods 58, as will be described below.

Figure 5:
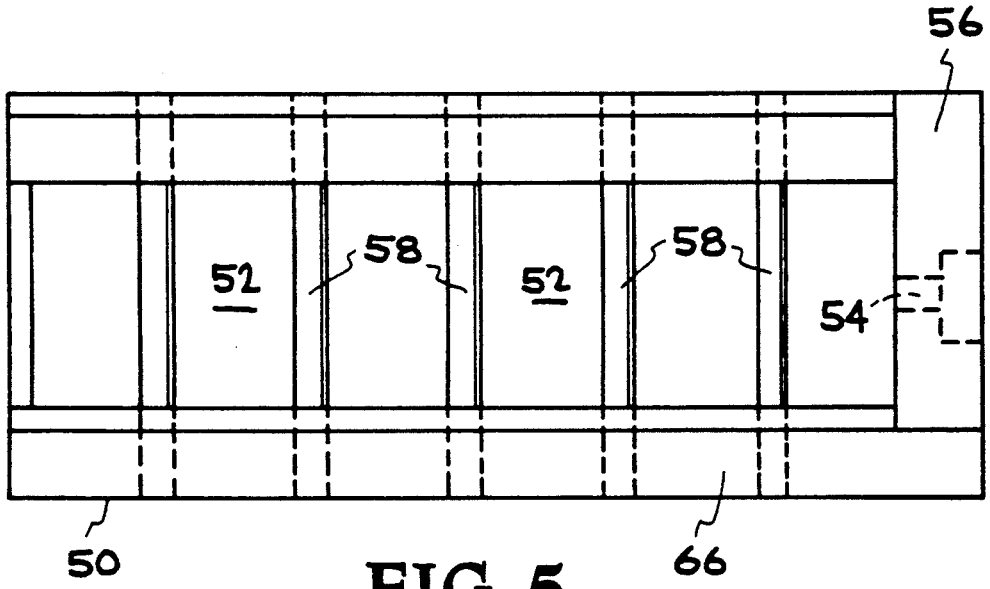
FIG. 5 is a plan view of the bottom segment of the connector, showing the central recess therein and the rods spanning the recess.
Figure 6:
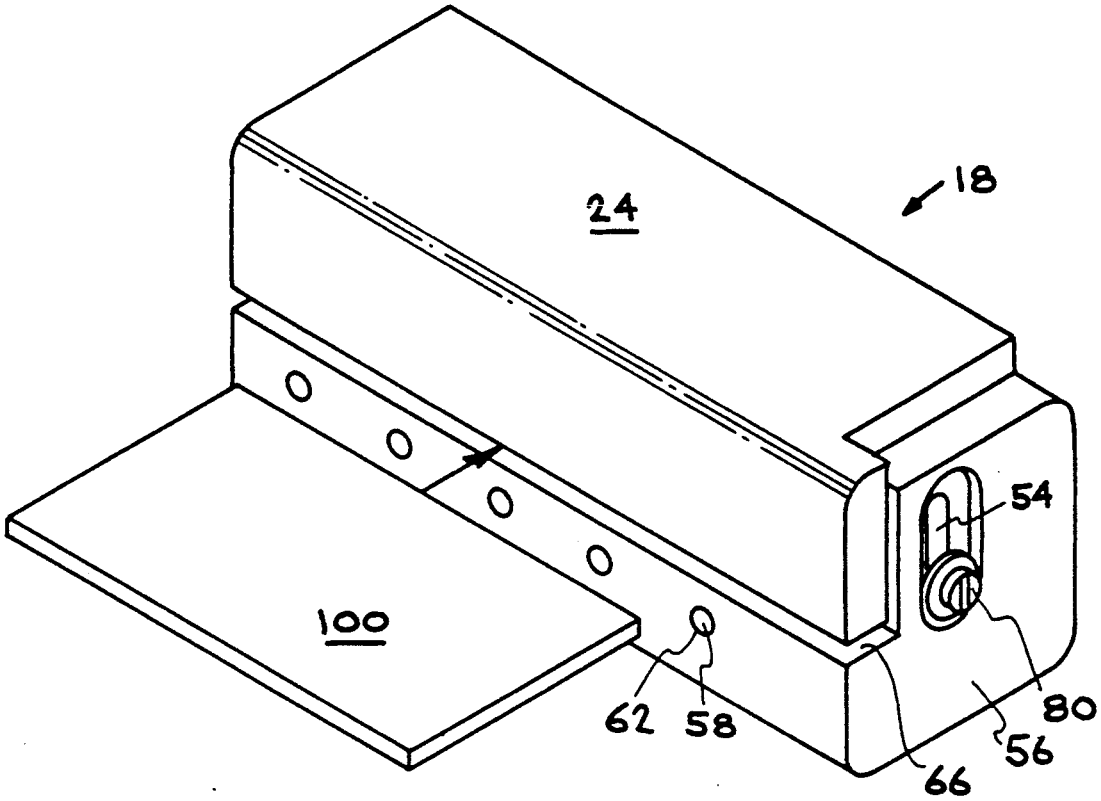
Figure 7:
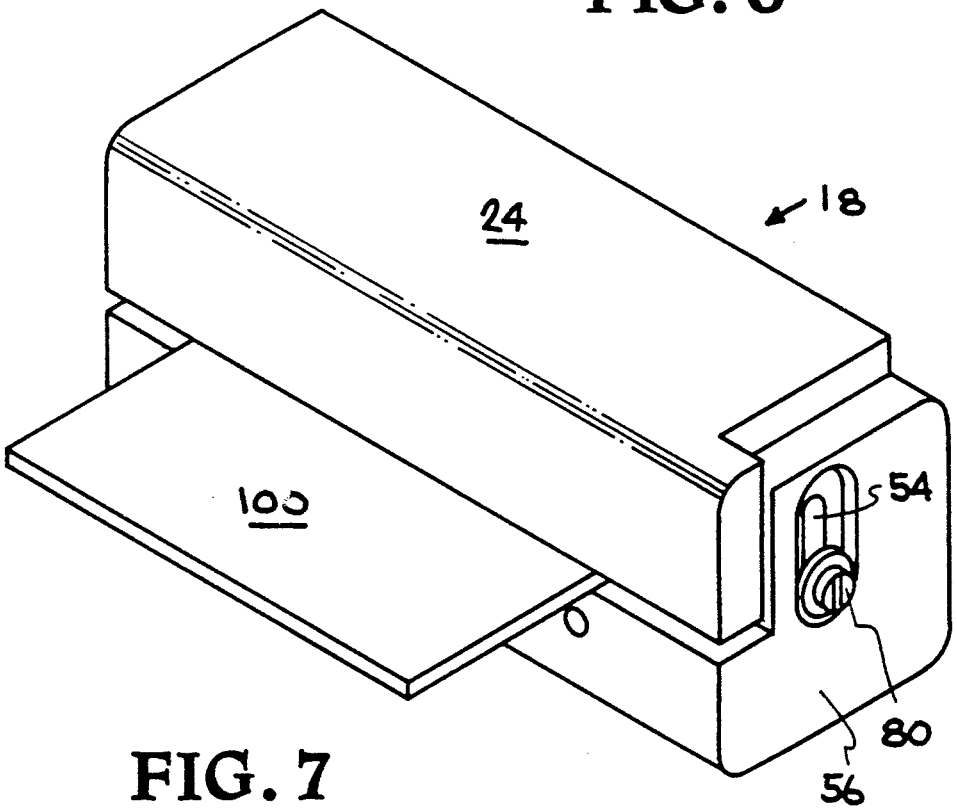
FIG. 7 is an isometric view of the connector of FIGS. 3 and 6, but with the conductive sheet inserted and clamped in place between the connector contacting surfaces by the tightening of the bolt to thereby urge both contacting surfaces into clamping engagement of the conductive sheet.

Second connector segment 50 is provided with a large rectangular recess 52 (as best seen in FIG. 5) which may extend completely through second connector segment 50. Slanted teeth 30 of upper connector segment 20 are received into recess 52 when the connector is assembled. Spanning across the narrow dimension of rectangular recess 52 are a series of parallel and spaced apart pins or rods 58, as best seen in FIG. 5, which are received in openings or drilled holds 62 in connector segment 50 on both sides of recess 52. As shown in FIG. 3, pins 58 are located about midway between the top of recess 52 and the bottom of connector segment 50, as viewed in FIG. 4. Second connector segment 50 is also provided with a cutaway portion 60 extending along one edge of connector segment 50 parallel to the long dimension of recess 52 defining a shoulder 66 which will comprise a second conductor contact surface which faces first conductor contact surface 26 and will clamp against the opposite surface of conductor 100 when it is inserted into the gap between the two connector contact surfaces, as illustrated in FIGS. 6 and 7.

Figure 8:
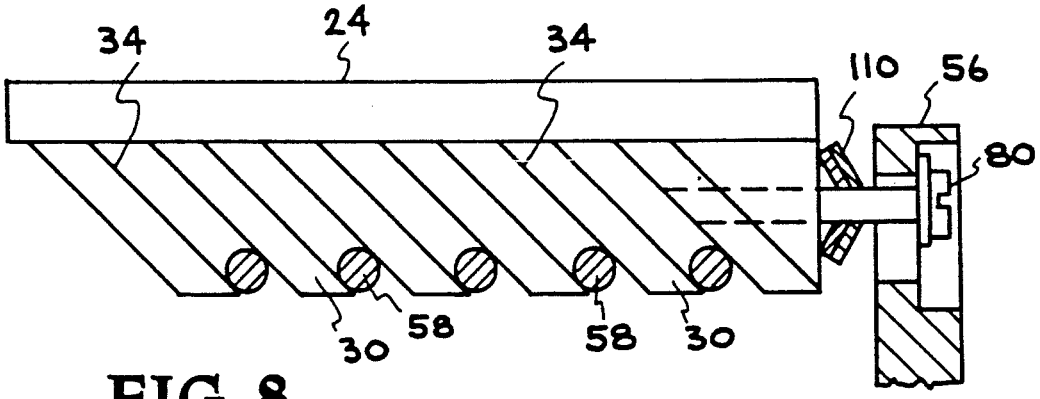
FIG. 8 is a fragmentary illustration of the camming interaction between the slanted teeth on the first segment of the connector and the rods spanning the recess in the second segment of the connector as the teeth first enter the recess and engage the rods.
Figure 9:
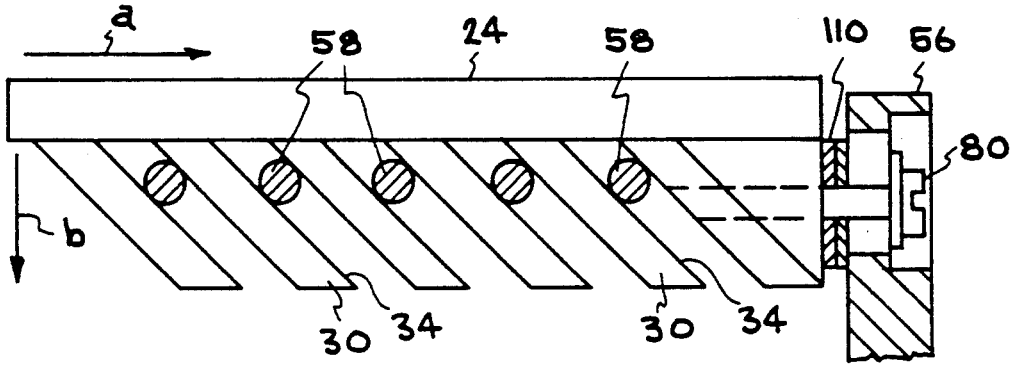
FIG. 9 is another fragmentary illustration of the camming interaction between the slanted teeth on the first segment of the connector and the rods spanning the recess in the second segment of the connector, as in FIG. 7, but at a later sequence as the actuating screw is tightened whereby the camming action of the slanted teeth against the rods forces the upper first segment of the connector carrying the teeth to move downward toward the second segment, as well as laterally toward the actuating screw.

Turning now to FIGS. 8-9, the camming action between rods 58 and surfaces 34 on teeth 30 is shown. When actuating screw 80 is inserted into slot 54 of connector segment 50 and then screwed into threaded bore 42 of connector segment 20, connector segment 20 is drawn laterally toward end section 56 of connector segment 50 (movement along arrow a shown in FIG. 9). This causes surfaces 34 on teeth 30 to slide on rods 58 which, in turn, causes connector segment 20 to also move toward connector segment 50 (movement along arrow b in FIG. 9), i.e., downwardly as viewed in FIGS. 3, 6, 8, and 9 so that the respective conductor contact surfaces 26 and 66 shown in FIGS. 3, 6, and 7 move toward each other. By providing a plurality of such spaced apart teeth 30 and rods 58 on respective connector segments 20 and 50, and spacing such rods and teeth along the lateral dimension of the connector segments parallel to conductor contact surfaces 26 and 66, an even, high mechanical contact pressure will be exerted against conductor sheet 100 by conductor contact surfaces 26 and 66, when conductor sheet 100 is inserted in the gap between surfaces 26 and 66 and actuating screw 80 is then subsequently tightened.

Figure 10:
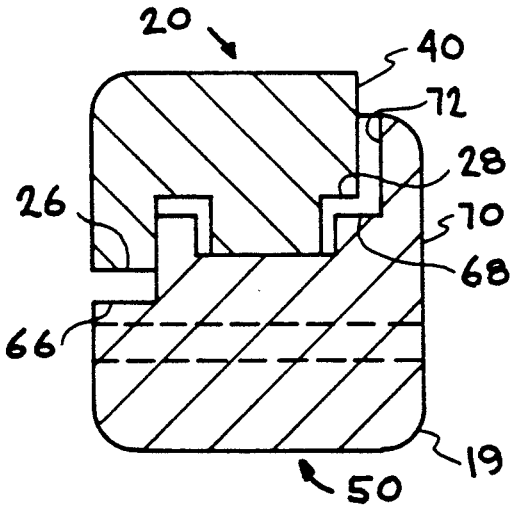
FIG. 10 is a section view of a midpoint in FIG. 6 showing the two segments of the connector just before insertion of the conductor sheet between the opposite conductor sheet contacting surfaces of the connector.

In FIG. 10, a cross-sectional view of connector 18 is shown with a gap between conductor contact surfaces 26 and 66. It will be noted that upper connector segment 20 and lower connector segment 50 are each provided with second facing surfaces, surface 28 on connector segment 20 and surface 68 on connector segment 50. These surfaces are spaced apart a distance which defines a gap which is smaller than the gap between conductor contact surfaces 26 and 66 by approximately the thickness of conductor sheet 100. Therefore, when the respective connector segments clamp conductor sheet 100 between surfaces 26 and 66 thereon, second surfaces 28 and 68 on connector segments 20 and 50 will also make contact with one another. This additional contact or bearing force exerted by the respective connector segments against one another via contact between second surfaces 28 and 68 prevents sideways tilt of the respective connector segments as they are clamped against conductor sheet 100.

FIG. 10 also shows a raised portion 70 on second connector segment 50 which has a side surface 72 facing side surface 40 on first connector segment 20. Raised portion 70 acts as a guide for first connector segment 20 as segment 20 moves in two directions, with respect to segment 50, as actuating screw 80 is either tightened or untightened. As shown in FIG. 8, belleville washers 110, situated between segments 20 and 50, and around actuating screw 80, act to release the clamping action on conductor 110 when screw 80 is untightened.

It will be noted in FIGS. 10-13, that connector 18 is preferably provided with rounded corners 19 which is preferable when high voltage high frequencies are used to power laser head 4 from power supply 2 so that electric fields, emanating from the connector are smoother than if square corners were presented. As a result the possibility of arcing from connector 18 to nearby devices or structures is reduced.

Figure 11:
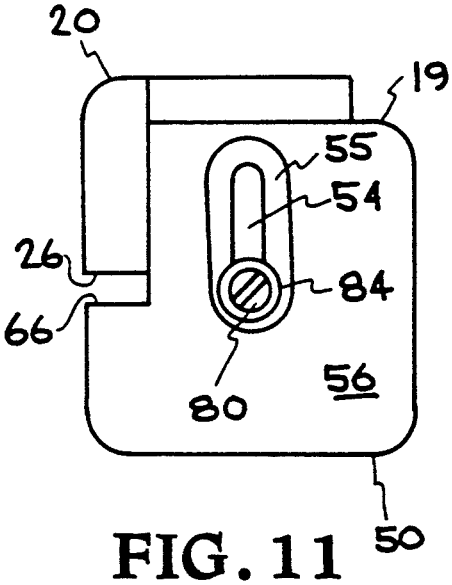
FIG. 11 is a view of the actuating screw end of the connector of FIG. 6 just before insertion of the conductor sheet between the opposite contacting surfaces of the connector.

FIG. 11 further shows the enlarged oval slot 54 provided in connector segment 50 for insertion of actuating screw 80 therein. The reason for the oval counterbored shape of slot 54 is because the camming action provided by the engagement of cam surfaces 34 on teeth 30 of connector segment 20 with rods 58 on connector segment 50 results in the movement of connector segment 20 in two directions, one in the direction of the axis of actuating screw 80 (arrow a in FIG. 9), and also in a direction perpendicular to the axis of actuating screw 80, i.e., parallel to the major axis of slot 54 (along arrow b in FIG. 9). The head 84 of actuating screw 80 is preferably mounted flush to sub-flush within an oval or "obround" shaped recess 55 in segment 56 to reduce electric field concentrations and subsequent arcing.

Figure 12:
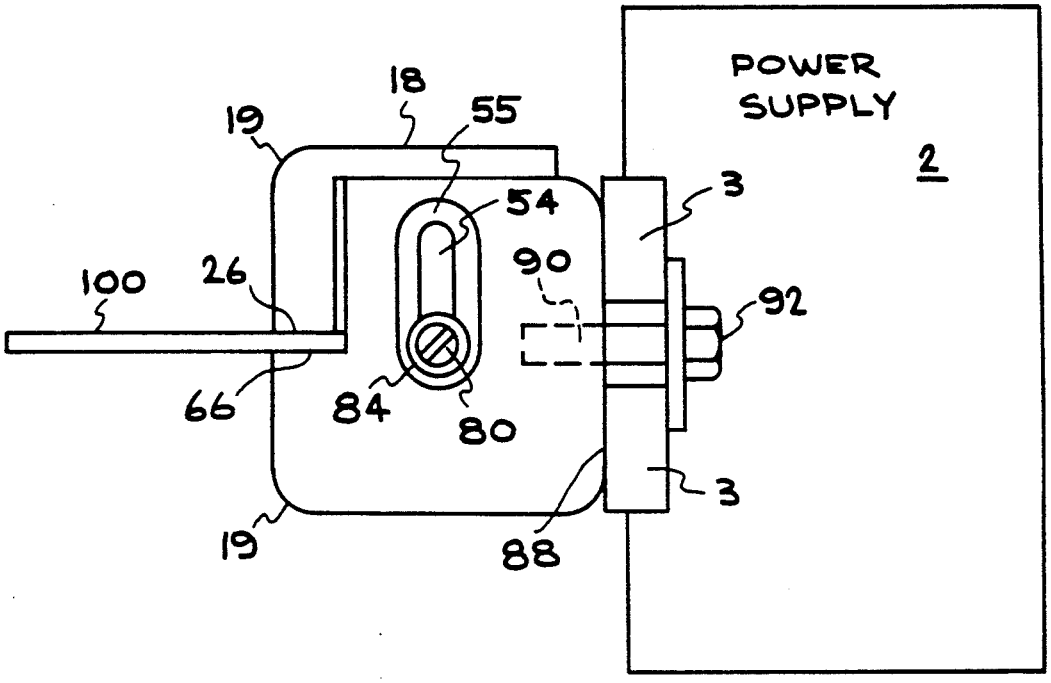
FIG. 12 is a top view of the connector of the invention showing the conductor sheet clamped by the contacting surfaces and the connector, in turn, electrically connected to the power supply for the laser head.

FIG. 12 shows connector 18 mounted to power supply 2 and with conductor sheet 100 firmly clamped between surfaces 26 and 66 of connector 18, i.e., with connector 18 in the closed position. Bolts 92 are shown securing connector 18 against insulators 53 on power supply 2. A similar connector (not shown) mounted on laser head 4, and clamped to the opposite end of conductor sheet 100 would complete the electrical connection of conductor sheet 100 between power supply 2 and laser head 4. Of course, to complete the electrical connections between the power supply and the load such as laser head 4, two such connectors would normally be mounted on power supply 2 for use with two conductor sheets 100. However, it should be noted that it is not necessary to provide the connector of the invention on both ends of conductor sheet 100, since one of the purposes or advantages of connector 18 is that it permits rapid and easily accessible disengagement and removal of power supply 2 from laser head 4, and this can be accomplished even if laser head 4 is connected to conductor sheet 100 using conventional prior art connecting means.

Figure 13:
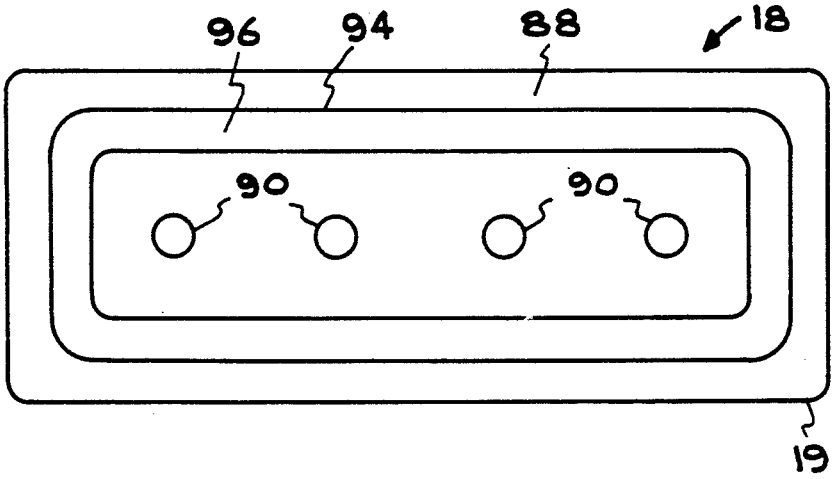
FIG. 13 is a vertical view of the side of the connector which is fastened to the power supply in FIG. 12.

FIG. 13 shows side 88 of connector 18 which faces and is fastened to the electrical device, e.g., either power supply 2 or laser head 4, with threaded bores 90 provided in connector 18 to receive fastening bolts 92, shown in FIG. 12, to provide both mechanical support and electrical communication between connector 18 and the electrical device. In the illustrated embodiment, connector 18 is further provided with an oval groove 94 in side 88 facing the electrical device, with an o-ring 96 receivable in groove 94 to thereby provide a liquid and gas-tight resilient mechanical connection between connector 18 and the electrical device.

Thus, the electrical connector of the invention provides an even clamping pressure across the width of a conductor sheet, while using on a single, and easily accessible, actuating screw or bolt, wherein forces exerted along the axis of the actuating screw are translated into forces perpendicular to the axis of the actuating screw with great mechanical advantage and evenly distributed along the width of the conductor strip by the interaction between a plurality of angled teeth and camming surfaces thereon on one segment of the connector and a plurality of rods on the other segment of the connector which are engaged by the camming surfaces of the slanted teeth. The results is an even exertion of pressure along one edge of the conductor strip by conductor contact surfaces on both segments of the connector, which respectively engage the opposite surfaces of the one edge of the conductor sheet. Since high frequency electrical currents are known to flow principally on the surfaces of conductors, this invention is superior to the prior art due to the continuous conductor contact planes.

While a specific embodiment of the electrical connector of the invention has been illustrated and described, modifications and changes of the apparatus, parameters, materials, etc. will become apparent to those skilled in the art, and it is intended to cover in the appended claims all such modifications and changes which come within the scope of the invention.

What is claimed is:

1. A two piece electrical connector for evenly contacting a metal conductor sheet along an entire edge of the surface thereof which comprises:

a) a first connector segment having a first conductor contacting surface thereon to contact one surface of said metal conductor sheet;

b) a series of parallel teeth depending from said first connector segment which are slanted with respect to said first conductor contacting surface, each of said teeth having a camming surface thereon;

c) a threaded bore in one end of said first connector segment;

d) a second connector segment having an elongated slot at one end thereof;

e) a single actuating screw passing through said elongated slot in said second connector segment and received in said threaded bore in said first connector segment to secure said first and second connector segments together;

f) a second conductor contacting surface disposed parallel to and facing said first conductor contacting surface when said two connector segments are secured together by said adjusting screw;

g) a rectangular recess in said second connector segment facing said first connector segment and dimensioned to accept therein said slanted teeth depending from said first connector segment; and h) a series of spaced apart rods mounted in said second connector segment bridging said recess and positioned to permit said teeth to pass between said rods, with said camming surfaces on said teeth in contact with said rods;

whereby as said actuation screw is tightened, said camming surfaces on said slanted teeth will engage said rods to urge said first connector segment toward said second connector segment in a direction perpendicular to said actuation screw axis, so that said first and second contacting surfaces will exert even pressure, along the entire length of said conductor contacting surfaces, against the opposite surfaces of a conductor sheet placed between said contacting surfaces of said connector.

2. The two piece connector of claim 1 wherein said slanted teeth define an angle of from about 10° to about 80°, with respect to the plane of said first conductor connecting surface.

3. The two piece connector of claim 2 wherein said slanted teeth define an angle of from about 25° to about 65°, with respect to the plane of said first conductor connecting surface.

4. The two piece connector of claim 2 wherein said slanted teeth define an angle of from about 30° to about 60°, with respect to the plane of said first conductor connecting surface.

5. The two piece connector of claim 2 wherein said slanted teeth define an angle of from about 40° to about 50°, with respect to the plane of said first conductor connecting surface.

6. The two piece connector of claim 2 wherein said slanted teeth define an angle of about 45°, with respect to the plane of said first conductor connecting surface.

7. The connector of claim 2 wherein said first and second connector segments are provided with second facing surfaces, spaced from said first and second conductor contacting surfaces and spaced apart from each other a distance substantially equal to the spacing between said first and second conductor contacting surfaces less the thickness of said conductor sheet; whereby sideways tilt of said respective connector segments as they are clamped against said conductor sheet will be inhibited.

8. The connector of claim 2 wherein corners on said first and second connector segments are rounded to inhibit arcing.

9. The connector of claim 2 wherein one side of said connector has a series of threaded holes therein to permit attachment of said connector to an electrical device.

10. The connector of claim 9 wherein said one side of said connector is provided with an annular groove in its surface which surrounds said threaded holes and is capable of receiving an o-ring therein whereby said connector may be mounted to an electrical device in a manner which will provide a liquid and gas-tight resilient mechanical connection there between.

11. The connector of claim 2 wherein the axis of said actuating screw is parallel to the planes of said first and second conductor connecting surfaces and the axes of said rods are also perpendicular to said planes of said first and second conductor connecting surfaces.

12. The connector of claim 11 wherein said slanted camming surfaces on said slanted teeth lie in parallel planes which are at an angle of from about 30° to about 60° to the plane of said conductor connecting surfaces and the axis of said actuating screw; and which respectively intersect the axes of said parallel rods; whereby tightening of said actuating screw causes said conductor connecting surfaces to move toward each other.

13. A two piece electrical connector for evenly contacting a metal conductor sheet along an entire edge of the surface thereof which comprises:

a) a first connector segment; said first connector segment comprising:
   i) a generally rectangular block;
   ii) a first rectangular conductor contacting surface on one side of said block to contact one surface of said metal conductor sheet;
   iii) a series of equally spaced apart parallel teeth depending from said block, each of said teeth having a camming surface thereon slanted at an angle of from about 30° to about 60°, with respect to a plane defined by said first conductor contacting surface; and
   iv) a threaded hole in one end of said first connector segment;

b) a second connector segment comprising:
   i) a generally rectangular block;
   ii) an elongated slot at one end of said second connector segment;
   iii) a second rectangular conductor contacting surface on said second block disposed parallel to and facing said first conductor contacting surface when said two connector segments are secured together;
   iv) a rectangular recess in said second block facing said slanted teeth depending from said first block and dimensioned to accept therein said slanted teeth, said rectangular recess having its longer dimension parallel to the longer dimension of said second rectangular conductor connecting surface;
   v) a series of spaced apart rods mounted in said second block bridging said recess and positioned to permit said teeth to pass between said rods, with said slanted camming surfaces on said teeth in contact with said rods;

c) a single actuating screw passing through said elongated slot in said second connector segment and received in said threaded bore in said first connector segment to secure said first and second connector segments together;

whereby said slanted camming surfaces on said teeth will engage said rods to urge said first connector segment toward said second connector segment in a direction perpendicular to said actuating screw axis when said actuating screw is tightened, so that said first and second conductor contacting surfaces will exert even pressure, along the entire length of said conductor contacting surfaces, against the opposite surfaces of a conductor sheet placed between said contacting surfaces of said connector.

* * * * *